US005426796A

United States Patent [19]

Stanton

[11] Patent Number: 5,426,796

[45] Date of Patent: Jun. 27, 1995

[54] SUPPORT BAR ACCESSORY FOR COLLAPSIBLE BED

[76] Inventor: Norman C. Stanton, 30950 Southwest River La., West Linn, Oreg. 97068

[21] Appl. No.: 255,414

[22] Filed: Jun. 8, 1994

Related U.S. Application Data

[63] Continuation-in-part of Ser. No. 81,029, Jun. 21, 1993, abandoned.

[51] Int. Cl.[6] ..... A47C 17/04

[52] U.S. Cl. ..... 5/13; 5/12.1; 5/226

[58] Field of Search ..... 5/12.1, 13, 226, 228, 5/663

[56] References Cited

U.S. PATENT DOCUMENTS

| | | | |
|---|---|---|---|
| 1,691,268 | 11/1928 | Conrad . | |
| 2,742,653 | 4/1956 | Woller | 5/13 |
| 3,431,567 | 3/1969 | Spitz et al. | 5/51 |
| 3,854,153 | 12/1974 | Fadler et al. | 5/13 |
| 3,892,001 | 7/1975 | Schneider | 5/354 R |
| 4,106,137 | 8/1978 | Leclerc | 5/24 |
| 4,381,570 | 5/1983 | Schneider | 5/13 |
| 4,442,556 | 4/1984 | Craigie | 5/13 |
| 4,494,258 | 1/1985 | Blevins et al. | 5/13 X |
| 4,504,987 | 3/1985 | Spitz | 5/13 |
| 4,754,505 | 7/1988 | Mizelle | 5/13 |
| 5,008,966 | 4/1991 | Lepow | 5/496 |

*Primary Examiner*—Michael F. Trettel
*Attorney, Agent, or Firm*—Stoel Rives Boley Jones & Grey

[57] ABSTRACT

A removable support accessory (30) is positionable relative to one or more support bars (15, 16) of a bed frame (12) of a collapsible bed (10) to provide a substantially greater support base and more planar bed and seat support planes (23, 82). The support accessory (30) thereby reduces discomfort that would otherwise be imposed by ridges, buckets, and rolling caused by sagging cables (20, 22) and the narrow support bars (15, 16). The support accessory (30) includes a longitudinal unit (34) having substantially rigid sections (38, 40) and nonrigid sections or hinges (46) that permit support accessory (30) to be compactly folded for storage. The support accessory (30) also includes a substantially rigid central unit (36) that extends the length of the nonrigid section (46) to provide continuous support along the length of the longitudinal unit (34). Velcro strips (58, 60, 68, and 70) are employed to secure the central unit (36) to the longitudinal unit (34), and the longitudinal unit (34) to the bed frame (12). The support accessory (30) can be employed when the collapsible bed (10) is extended in a bed-forming position (21) or collapsed in a sofa-forming position (80).

21 Claims, 2 Drawing Sheets

SUPPORT BAR ACCESSORY FOR COLLAPSIBLE BED

This application is a continuation-in-part of U.S. patent application No. 08/081,029, filed Jun. 21, 1993, now abandoned.

TECHNICAL FIELD

This invention relates to collapsible beds and, in particular, to a support bar accessory for a collapsible bed frame to alleviate discomfort caused by the support bar.

BACKGROUND OF THE INVENTION

The discomfort experienced from sleeping on collapsible beds, such as sofa beds and portable cots, is well known to most travelers. With reference to FIG. 1, a typical sofa bed 10 includes a sofa frame 11 and a bed frame 12 having two or more pivotally interconnected frame sections 14 including and separated by transverse distal and proximal support bars 15 and 16. Frame sections 14 also include side rails 18 that may cooperate with support bars 15 and 16 to support a fabric mesh or network 19 of lengthwise and widthwise cables 20 and 22 forming a grid-like pattern that defines a deformable bed support plane 23 (FIG. 4) when sofa bed 10 is extended in a bed-forming position 21. The cables 20 and 22 may be individually attached to coil-springs 24, support bars 15 and 16, or side rails 18.

When sofa bed 10 is extended in the bed-forming position 21, side rails 18 of frame sections 14 are typically positioned end-to-end to extend for the length of bed frame 12. Likewise, support bars 16 extend transversely across the width of bed frame 10, and are generally located in proximity to pivot points 25 of bed frame 10. Support bars 15 and 16 are typically positioned below or at the same level as cables 20 and 22.

In some sofa beds 10, support bars 15 and 16 are positioned at or above the bed support plane 23 to retain a flexible pad (not shown) above the cable network. In other sofa beds 10, support bars 15 and 16 are initially positioned below the bed support plane 23. However, use and time cause wear to cables 20 and 22 and coil-springs 24. This wear often causes the bed support plane 23 to drop as much as four inches below the level of support bars 15 and 16. Moreover, such support bars 15 and 16 tend to produce hard, narrow ridges in the typically thin mattresses that are provided to cover bed frame 12. These ridges tend to produce discomfort.

In a sofa bed 10 of a type (not shown in FIG. 1) having frame sections 14 that do not share common support bars 16, the resulting adjacent support bars 15 and 16 are not always at the same level when sofa bed 10 is in the bed-forming position 21. This disparity also tends to produce discomfort.

Despite these and other well known discomforts associated with collapsible beds, relatively few improvements have been suggested. U.S. Pat. No. 3,431,567 of Spitz, et al. describes a series of strap-like linking members to retain one horizontal, transverse cable in proximity to a support bar of the sofa bed frame. Although these straps may prevent seating cushions from sagging toward the back rest of the sofa frame when the sofa bed is collapsed in a seat-forming position, the straps do not prevent sagging toward the middle or the formation of sofa "buckets." Such sofa buckets may cause seated occupants to roll together or may hinder an occupant's ability to get out of the sofa from a seated position.

U.S. Pat. No. 3,892,001 of Schneider describes a flexible panel protector composed of an elongated, rectangular, laminar sheet of flexible, resiliently compressible padding sandwiched between a fiberglass base sheet and a decorative upholstery cover sheet. The flexible panel protector is attached between the front end and front legs of a sofa bed frame section. When the sofa bed is collapsed in a seat-forming position, the panel protector prevents the sofa seating cushions from being abrasively worn by the collapsed uppermost springs. It also conceals and even aesthetically decorates the unsightly uppermost springs in the event a seating cushion is dislodged from the sofa bed, and provides an intermediate cushiony effect between the uppermost springs and the removable cushion to enhance the comfort for seated occupants.

U.S. Pat. No. 1,691,268 of Conrad describes a collapsible bed that employs large partially detachable, flexible pads secured by straps to the bed frame. When the bed is collapsed, these pads are wound about rollers that are integral to the collapsible bed.

U.S. Pat. No. 5,008,966 of Lepow describes a sheet having Velcro TM (reversibly attachable nylon hooks and adhesive pile fabrics) strips mated to strips on a sofa bed mattress to secure the sheet to the mattress. The Velcro TM strips compensate for mattress-sofa attachment points that would interfere with placing a traditional fitted sheet onto the sofa bed mattress. This sheet may remain on the sofa bed when it is collapsed to the sofa-forming position.

U.S. Pat. No. 4,106,137 of Leclerc describes a sofa bed having a pivoting box-shaped frame adapted to receive a spring mattress. A durable flexible sheet cover extends over the mattress and is secured to the frame to hold blankets against the mattress while the sofa bed is collapsed in the sofa-forming position.

Despite the above-mentioned innovations in sofa-bed design, sofa beds still exhibit sagging and produce substantial discomfort as a consequence of the placement of rigid support bars transverse to the length of the bed.

SUMMARY OF THE INVENTION

An object of the present invention is, therefore, to increase the comfort of collapsible beds when they are extended in the bed-forming position.

Another object of the invention is to increase the comfort of sofa beds when they are collapsed in the sofa-forming position.

A further object of the invention is to provide a support accessory to reduce discomfort caused by one or more support bars positioned underneath a mattress.

Yet another object of the invention is to provide such a support accessory that is detachable and convenient to install and remove.

Still another object of the present invention is to provide such a support accessory that may be stored or transported in a compact manner.

A removable support accessory is positionable relative to a transverse support bar comprising part of the bed frame of a collapsible bed when it is extended in the bed-forming position. The support accessory may also remain functionally assembled over or in proximity to the support bar when the collapsible bed is collapsed in the sofa-forming position. The support accessory is preferably sized to have a width that permits it to remain functionally assembled without adjustment on the sofa bed as it collapses to the sofa-forming position. The support accessory provides a substantially greater support base and thus reduces discomfort, such as buckets, rolling, and ridges, associated with a narrow support bar and a sagging cable network.

The support accessory comprises a longitudinal unit having substantially the same length as, and being significantly wider than the width of, the transverse support bar. The support accessory is preferably substantially rigid along most of length and includes one or more hinge joints permitting the support accessory to be compactly folded for convenient storage. The hinge joints may be provided, for example, by substantially flexible portions joining the adjacent rigid sections.

According to a preferred embodiment, two substantially rigid sections are joined by a central nonrigid section. A detachable, substantially rigid central unit that extends the length of the nonrigid central section may also be provided to permit continuous support along the length of the longitudinal unit. Velcro strips are employed to secure the central unit to the longitudinal unit, and the longitudinal unit to the bed frame.

Additional objects and advantages of the present invention will be apparent from the following detailed description of preferred embodiment thereof, with reference to accompanying drawings.

DETAILED DESCRIPTION OF PREFERRED EMBODIMENT

Figure 1:
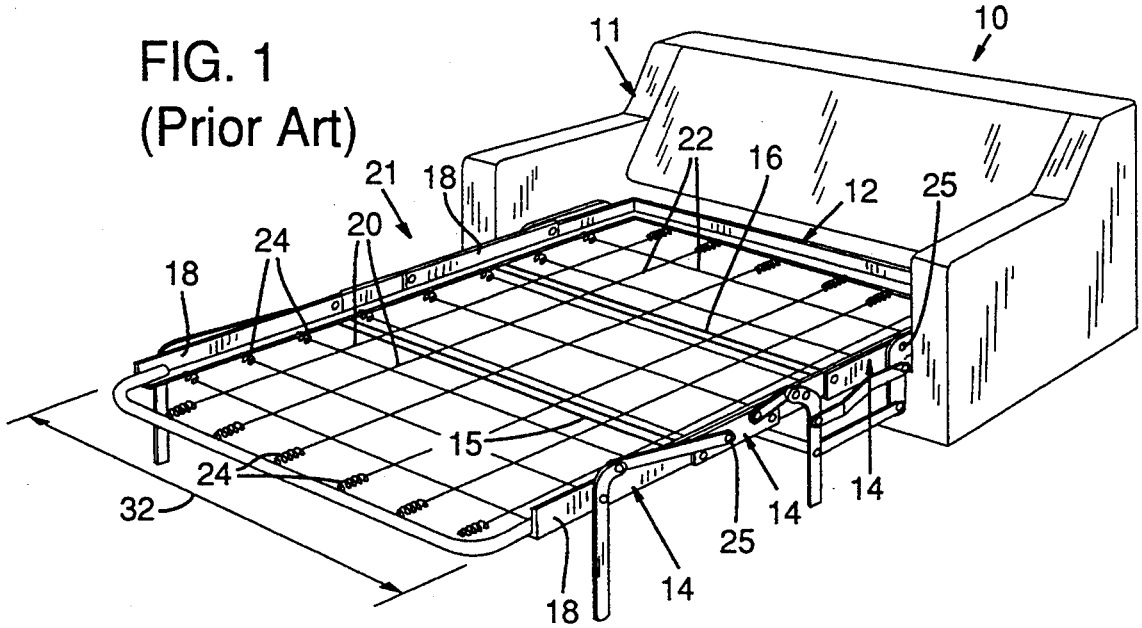
FIG. 1 (Prior Art)
FIG. 1 is an elevated isometric view of a conventional prior art sofa bed extended in a bed-forming position.
Figure 2:
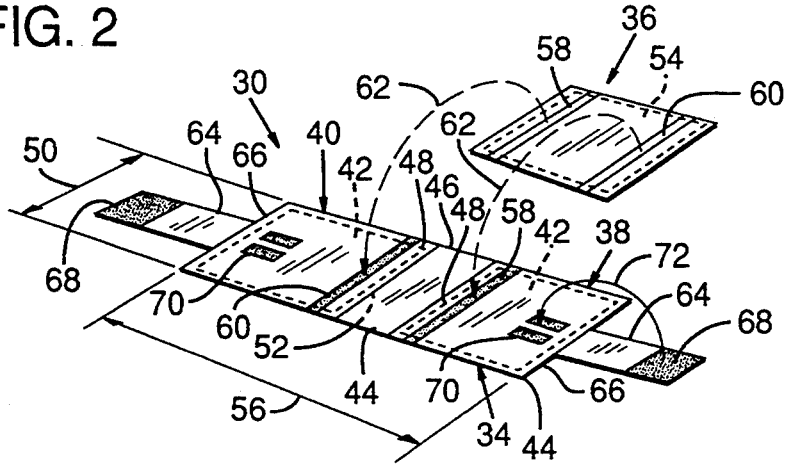
FIG. 2 is a partly exploded, elevated, isometric view of a preferred embodiment of a support accessory of the present invention.

FIG. 2 shows a preferred embodiment of a support accessory 30 that extends for substantially the length 32 of proximal support bar 16 (FIG. 1). Persons skilled in the art will appreciate that support accessory 30 may extend only 75% of the length 32 of support bar 16 or width of bed frame 12 of sofa bed 10.

Support accessory 30 comprises a generally rectangular, longitudinal unit 34 and a detachable central unit 36. Longitudinal and central units 34 and 36 are significantly wider than support bar 16 (at least twice its width) to provide a sufficient support base to reduce discomfort associated with support bar 16.

Longitudinal unit 34 includes two substantially rigid rectangular end sections 38 and 40 separated by and mutually joined to a flexible central section 46. According to a preferred embodiment, substantially rigid end sections 38 and 40 comprise 20-inch (51-centimeter) long, 12-inch (30-centimeter) wide, ½-inch (1.3-centimeter) thick rigid board sections 42 covered by a covering 44, such as cloth, and flexible central section 46 comprises an 8-inch (20-centimeter) long section of nonrigid cloth. Desired dimensions vary, of course, depending on the dimensions of sofa bed 10 and support bars 15 and 16. Persons skilled in the art will appreciate that end sections 38 and 40 may be constructed from a variety of materials having sufficient rigidity such that they do not substantially deform when bearing weight while functionally assembled in proximity to or over support bar 16. Such materials include, for example, metal, wood, plastic, and the like.

Coverings 44 for each end section 38 and 40 and central section 46 are preferably joined to form enclosures for rigid board sections 42. Enclosure joints 48, which may be provided by stitching, adhesive, or the like, preferably extend along width 50 of covering 44 at medial ends 52 of board sections 42 to form enclosures and separate board sections 42 from central section 46. Flexible central section 46 forms a "hinge" that allows support accessory 30 to be folded and easily stored.

Figure 3:
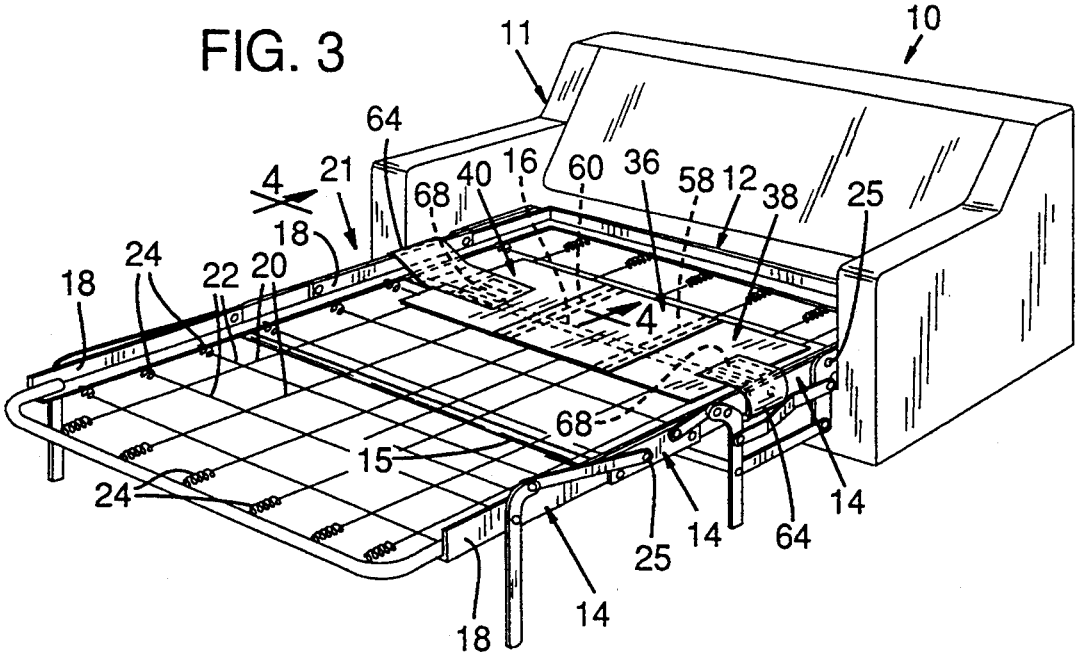
FIG. 3 is an elevated isometric view of the support accessory of FIG. 2, functionally assembled on a sofa bed of FIG. 1 extended in a bed-forming position.
Figure 4:
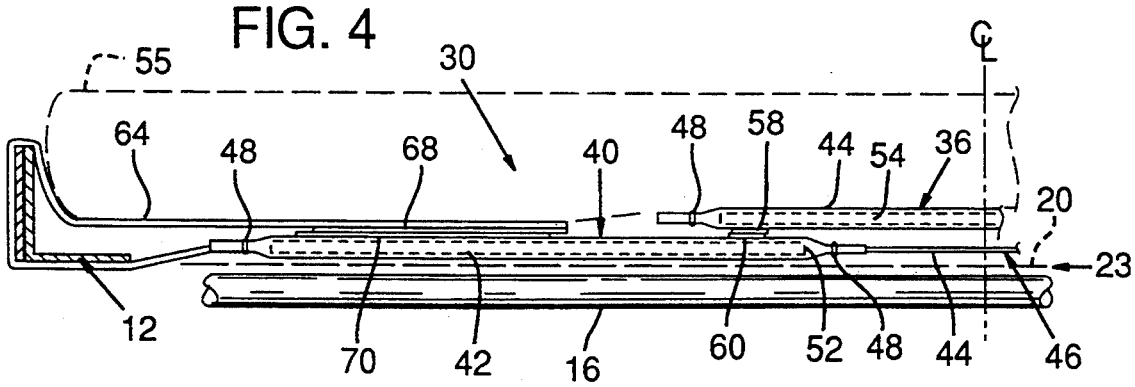
FIG. 4 is a portion of a cross sectional view taken along lines 4—4 of FIG. 3 of a functionally assembled support accessory sandwiched between a mattress and a bed frame of a sofa bed.

FIG. 3 shows a support accessory 30 functionally assembled on sofa bed 30 extended in a bed-forming position and FIG. 4 shows a portion of a cross-sectional view taken along lines 4—4 of FIG. 3 of a support accessory 30 sandwiched between bed frame 12 and a mattress 55. Support accessory 30 is preferably positioned elevationally above mesh 19 and adjacent to or within about two to four inches (5.1–10.2 centimeters) of support bar 16.

With reference to FIGS. 2, 3, and 4, central unit 36 comprises a 20-inch (51-centimeter) rigid overlay 54 that has a lengthwise dimension that is longer than that of flexible central section 46 and rests over medial ends 52 of rigid board sections 42 comprising longitudinal unit 34. Central unit 36 provides continuous support along length 56 (48 inches (122 centimeters)) of longitudinal unit 34. Mating Velcro TM strips 58 and 60 provided on covering 44 of rigid end sections 38 and 40 permit detachable installation of central unit 36 as indicated by arrows 62.

Straps 64 extending from distal ends 66 of longitudinal unit 34 wrap around side rails 18 of sofa bed 10 to hold support accessory 30 in place. Straps 64 have Velcro TM ends 68 that are mated to Velcro TM strips 70 provided on covering 44 for end sections 38 and 40 to secure straps 64 in place as indicated by arrow 72.

An attractive feature of this embodiment of support accessory 30 is that end sections 38 and 40 of the longitudinal unit 34 and central unit 36 are of the same length to permit support accessory 30 to be folded into a compact arrangement for easy storage and transport. Central section 46 may also be fabricated with one or more creases to facilitate folding, and additional Velcro TM strips may be employed in conjunction with straps 64 to facilitate compact portage and storage of support accessory 30.

Support accessory 30 is employed by first securing it on an extended sofa bed framework 12, as previously discussed, and then covering it with the mattress 55 supplied with sofa bed 10. Support accessory 30 provides a substantially greater support base to create a more planar bed support plane 23 than provided by narrow support bars 15 and 16 and sagging cables 20 and 22. Thus, support accessory 30 causes sofa bed 10 to provide greater comfort in the bed-forming position 21. The discontinuity caused by the raised ends of central unit 36 over the two boards 42 forming longitudinal unit 34 does not adversely affect sleeping comfort because support accessory 30 fits under mattress 55.

Figure 5:
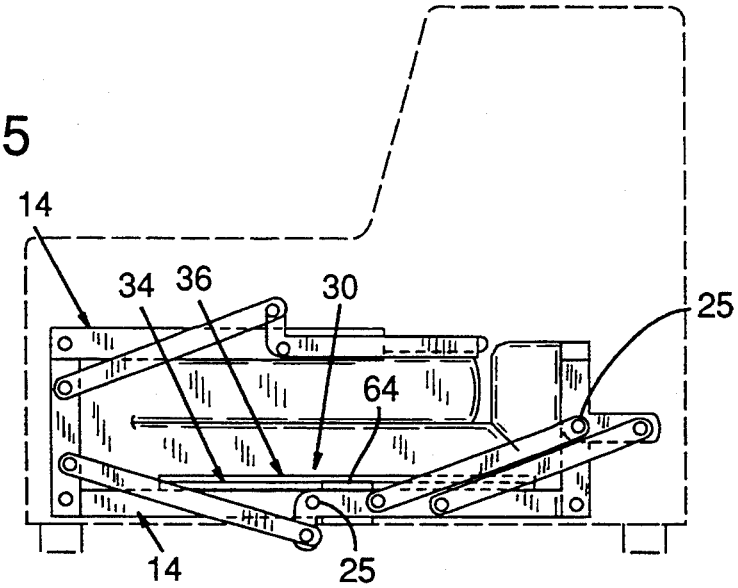
FIG. 5 is a cross sectional, side view of a sofa bed in the sofa-forming position with a functionally assembled support accessory.

FIG. 5 is a cross sectional, side view of a sofa bed in the sofa-forming position with a functionally assembled support accessory 30. With reference to FIG. 5, skilled persons will appreciate that support accessory 30 may remain functionally assembled over or in proximity to support bar 16 as sofa bed 10 is extended to the sofa-forming position 80. Thus positioned, support accessory 30 provides a substantially planar seat support plane 82 for seat cushions of sofa bed 10 and substantially eliminates buckets or rolling typically associated with sagging cables 20 and 22. Although support accessories 30 are preferably provided for each transverse support bar 15 and 16 of collapsible sofa bed 10, skilled persons will note that a support accessory 30 positioned over or in proximity to support bar 15 may have to be removed, or have its position adjusted, to permit sofa bed 10 to be collapsed to the sofa-forming position 80.

Persons skilled in the art will appreciate that central unit 36 may be sized to fit between rather than overlap end sections 38 and 40, wherein Velcro TM strips 58 and 60 would be attached to cloth central section 46. Thus positioned, substantially rigid central unit 36 and end sections 38 and 40 provide a substantially continuous, planar, rigid longitudinal unit 34 having a length corresponding generally to that of support bar 16.

Persons skilled in the art will also appreciate that support accessory 30 has numerous embodiments. Longitudinal unit 34 may comprise several rigid, perhaps nonrectangular, sections of various dimensions joined by various types of hinge joints. Support accessory 30 may, for example, employ two or more substantially rigid sections that are connected by metal hinges or are adapted to fit or interlock together. Support accessory 30 may alternatively employ a longitudinal unit 34 having numerous rigid, transverse, side-by-side, slats mounted on a nonrigid material, such that support accessory 30 may be "rolled up" for storage.

It will be obvious to those having skill in the art that many changes may be made to the details of the above-described preferred embodiment of the present invention without departing from the underlying principles thereof. The scope of the present invention should, therefore, be determined only by the following claims.

I claim:

1. An accessory positionable on a collapsible bed frame having a transverse support bar, a width, and a deformable bed support plane, comprising:

a longitudinal unit comprising at least two nonrigidly connected, substantially rigid sections having a combined length that is less than or equal to the width of the bed frame, the longitudinal unit being adapted for positioning in proximity to the transverse support bar and having a width sufficient to increase the flatness of a portion of the bed support plane in proximity to the transverse support bar; and a user-operable fastener connected to at least one of the rigid sections for securing the accessory to the bed frame.

2. The accessory of claim 1 in which the longitudinal unit additionally comprises a nonrigid section.

3. The accessory of claim 2 in which the longitudinal unit comprises at least two substantially rigid sections joined to a central nonrigid section.

4. The accessory of claim 3 in which the sections are joined by easily refastenable complementary hook and loop fabric strips.

5. The accessory of claim 2 additionally comprising a substantially rigid removable section having dimensions corresponding generally to the nonrigid section and positionable at the nonrigid section to provide a substantially continuous rigid longitudinal unit.

6. The accessory of claim 5 in which the accessory has a generally planar top surface and in which the transverse support bar and the top surface of the accessory lie generally in the bed support plane.

7. The accessory of claim 4 in which the removable rigid section is attachable to the nonrigid section between first and second rigid sections of the longitudinal unit.

8. The accessory of claim 7 in which the rigid sections comprise wood.

9. The accessory of claim 7 in which the rigid sections form a substantially planar surface in a connected condition.

10. The accessory of claim 1 in which a strap is provided at each end of the longitudinal unit to secure the accessory to the bed frame.

11. The accessory of claim 10 in which the strap comprises easily refastenable complementary hook and loop fabric strips.

12. The accessory of claim 1 in which the rigid section comprises wood.

13. The accessory of claim 1 in which the substantially rigid sections are connected by hinge joints.

14. The accessory of claim 1 in which the longitudinal unit is adapted for remaining connected to the bed frame whenever it is in a bed-forming position, whenever it is in a sofa-forming position, and whenever it is in transition between the bed-forming and sofa-forming positions.

15. The accessory of claim 14 in which the longitudinal unit provides a substantially planar seat support plane for the bed frame whenever it is in the sofa-forming position.

16. The accessory of claim 14 in which the longitudinal unit additionally comprises a nonrigid section.

17. The accessory of claim 16 additionally comprising a substantially rigid removable section having dimensions corresponding generally to the nonrigid section and positionable at the nonrigid section to provide a substantially continuous rigid longitudinal unit.

18. The accessory of claim 17 in which the removable rigid section is attachable to the nonrigid section between the rigid sections of the longitudinal unit.

19. The accessory of claim 18 in which the rigid sections comprise wood.

20. The accessory of claim 1 in which the accessory has a generally planar top surface and in which the bed support plane generally includes the transverse support bar and the top surface of the accessory.

21. The accessory of claim 1 in which the accessory is adapted to be positioned at an elevational level that is higher than that of the support bar.

* * * * *

UNITED STATES PATENT AND TRADEMARK OFFICE

CERTIFICATE OF CORRECTION

PATENT NO. : 5,426,796

DATED : June 27, 1995

INVENTOR(S) : Norman C. Stanton

It is certified that error appears in the above-indentified patent and that said Letters Patent is hereby corrected as shown below:

Column 6, line 13, change "4" to --5--.

Signed and Sealed this

Fifth Day of September, 1995

Bruce Lehman

BRUCE LEHMAN

*Commissioner of Patents and Trademarks*

*Attest:*

*Attesting Officer*